US012146671B1

(12) United States Patent
Srikrishna

(10) Patent No.: US 12,146,671 B1
(45) **Date of Patent: *Nov. 19, 2024**

(54) AUTOMATED ALERTS FOR AIR-PURIFIER MAINTENANCE BASED ON AIRFLOW AND FILTRATION EFFICIENCY

(71) Applicant: Patient Knowhow, Inc., San Mateo, CA (US)

(72) Inventor: Devabhaktuni Srikrishna, San Francisco, CA (US)

(73) Assignee: PATIENT KNOWHOW, INC., San Mateo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/407,019

(22) Filed: Jan. 8, 2024

Related U.S. Application Data

(63) Continuation of application No. 18/489,831, filed on Oct. 18, 2023.

(Continued)

(51) Int. Cl.
*G05B 15/02* (2006.01)
*F24F 11/39* (2018.01)

(Continued)

(52) U.S. Cl.
CPC ..... *F24F 11/39* (2018.01); *F24F 11/52* (2018.01); *F24F 2110/30* (2018.01); *F24F 2110/64* (2018.01)

(58) Field of Classification Search
CPC ..... F24F 11/39; F24F 11/52; F24F 2110/30; F24F 2110/64
See application file for complete search history.

(56) References Cited

U.S. PATENT DOCUMENTS

2016/0231039 A1* 8/2016 Song ..... F24F 11/49
2023/0273576 A1* 8/2023 Douglas ..... G05B 15/02 700/276

FOREIGN PATENT DOCUMENTS

DE 3337398 * 10/1983 ..... G01F 15/00
KR 20220160188 * 5/2021 ..... F24F 11/56
TW 202219665 * 7/2021 ..... E06B 9/24

OTHER PUBLICATIONS

D. Hagan et al., "Assessing the accuracy of low-cost optical particle sensors using a physics-based approach," Atmos. Meas. Tech., 13, 6343-55, Nov. 26, 2020.

(Continued)

*Primary Examiner* — Hongmin Fan
(74) *Attorney, Agent, or Firm* — Huse IP Law; Charles C. Huse

(57) ABSTRACT

An apparatus includes one or more particle sensors to measure an input particle load for an air purifier and an output particle load for the air purifier. The apparatus also includes one or more processors coupled to the one or more particle sensors, and memory storing one or more programs for execution by the one or more processors. The one or more programs include instructions for determining a filtration efficiency of the air purifier using the input particle load and the output particle load as measured by the one or more particle sensors, determining whether the filtration efficiency satisfies a threshold efficiency value, and generating a first alert in response to a determination that the filtration efficiency does not satisfy the threshold efficiency value.

16 Claims, 9 Drawing Sheets

Related U.S. Application Data

(60) Provisional application No. 63/418,474, filed on Oct. 21, 2022.

(51) Int. Cl.

| | |
|---|---|
| ***F24F 11/52*** | (2018.01) |
| *F24F 110/30* | (2018.01) |
| *F24F 110/64* | (2018.01) |

(56) References Cited

OTHER PUBLICATIONS

D. Srikrishna, "Can 10x cheaper, lower-efficiency particulate air filters and box fans complement High-Efficiency Particulate Air (HEPA) purifiers to help control the COVID-19 pandemic?," Science of the Total Environmnet 838 (May 14, 2022) 155884.

Patient Knowhow, Inc., "Supplementary Air Filtered Exchanges (SAFE)," https://www.patientknowhow.com/safe.html (downloaded Sep. 8, 2022).

Temtop, "PMD 331 Particle Counter User Manual," 2020 (accessed Aug. 29, 2022).

Testo, "testo 405i data sheet," https://static-int.testo.com/media/36/64/940859edd8b2/Testo-405i-Data-Sheet.pdf (accessed Aug. 31, 2022).

* cited by examiner

AUTOMATED ALERTS FOR AIR-PURIFIER MAINTENANCE BASED ON AIRFLOW AND FILTRATION EFFICIENCY

RELATED APPLICATIONS

This application is a continuation of U.S. patent application Ser. No. 18/489,831, filed on Oct. 18, 2023, which claims the benefit of U.S. Provisional Patent Application No. 63/418,474, filed on Oct. 21, 2022, both of which are incorporated by reference in their entirety.

TECHNICAL FIELD

This disclosure relates to air purifiers, and more specifically to maintenance for air purifiers.

BACKGROUND

Air purifiers are becoming increasingly important to remove a variety of common airborne contaminants from the air we breathe. Examples of such contaminants include viruses (e.g., Covid variants), bacteria, wildfire pollution, cooking-related pollution, diesel soot, and so on. An air purifier includes a filter and a fan. The cumulative time of usage of the air purifier may be monitored to attempt to determine if the filter's effectiveness or fan's speed has degraded and whether the filter or fan needs to be cleaned or replaced. The filter may also be visually inspected to see how dirty it looks, in an attempt to determine whether it needs to be cleaned or replaced. How much cumulative time the air purifier has been used and how dirty the filter appears, however, are unreliable indicators of actual air-purifier efficacy.

SUMMARY

Regardless of how long an air purifier has been used or how dirty its filter appears, the current effectiveness of its filter and fan is measured based on two factors: (1) how well the filter removes the airborne contaminants (i.e., filtration efficiency) and (2) the rate at which air passes through the filter and fan (i.e., airflow). Through usage, the airflow may be reduced due to the filter getting clogged by airborne contaminants, the fan may slow down due to wear and tear, and the filtration efficiency may also degrade.

The airflow and/or filtration efficiency of an air purifier may be automatically monitored to detect whether airflow and/or filtration efficiency have been reduced. If the airflow and/or filtration efficiency have been reduced by specified amounts, the user of the air purifier is alerted to take corrective action. For example, based on an alert, the user of the air purifier may perform maintenance on the air purifier by cleaning or replacing the filter and/or the fan.

BRIEF DESCRIPTION OF THE DRAWINGS

For a better understanding of the various described implementations, reference should be made to the Detailed Description below, in conjunction with the following drawings.

Like reference numerals refer to corresponding parts throughout the drawings and specification.

DETAILED DESCRIPTION

Figure 1:
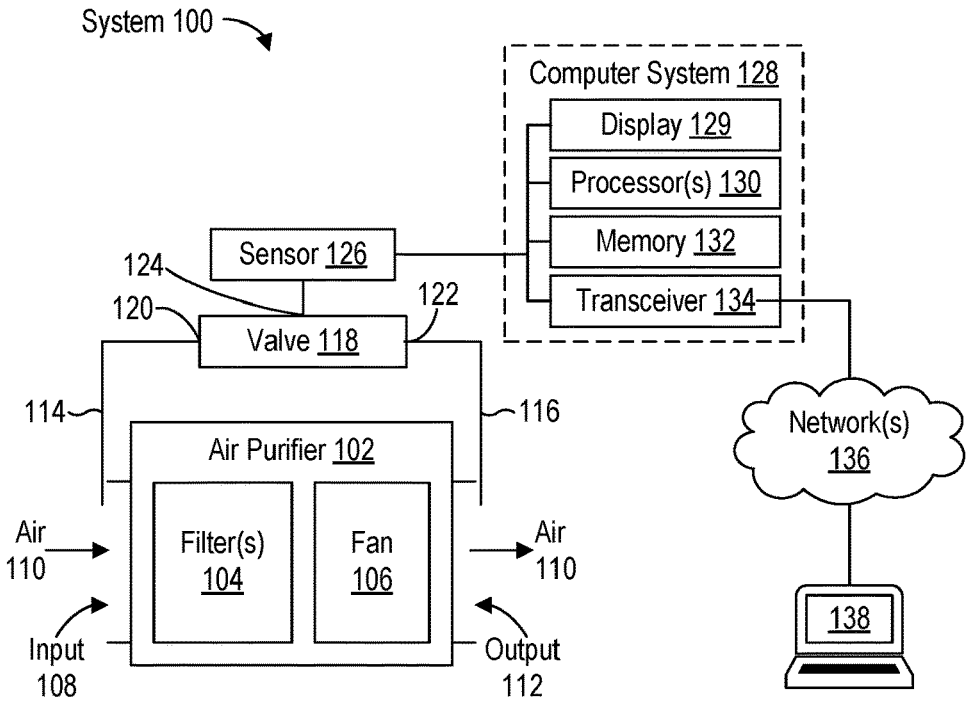
FIG. 1 shows a system with an air purifier, a valve, a single particle sensor, and a computer system communicatively coupled to the sensor, in accordance with some embodiments.

Reference will now be made in detail to various embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

An air purifier includes one or more filters and one or more fans. In some embodiments, the air purifier also includes one or more particle sensors (i.e., particulate matter (PM) sensors) to measure input particle loads (e.g., concentrations) for the air purifier and output particle loads (e.g., concentrations) for the air purifier. The input particle loads may be particle loads at an input of the air purifier and the output particle loads may be particle loads at an output of the air purifier. Alternatively, the input particle loads may be measured at other locations that have effectively the same particle load as the input at any given time, due to air flow between the input and the other location. For example, the input particle loads may be measured in front of the input or on a side of the air purifier for which the particle load is expected to be the same as at the input (e.g., a side on which the output of the air purifier is not located). In another example, assuming adequate airflow in a room where the air purifier is located, the input particle loads are particle loads in the room when the air purifier isn't running. Input particle loads therefore may even be measured at the output of the air purifier when the one or more fans of the air purifier are not running, as long as one waits long enough for the air at the input and output of the air purifier to equilibrate after turning off the air purifier before taking the measurement. One or more fans of an air purifier thus may be turned off to measure respective input particle loads and then turned back on, with the output particle loads being measured while the air purifier is on, in accordance with some embodiments. The output particle loads may alternatively be measured at other locations besides the output that have effectively the same particle load as the output at any given time while the air purifier is running (e.g., immediately in front of the output or in a tube coupled to the output).

The one or more particle sensors may include (e.g., be) optical particle sensors. For example, the particle sensors may include (e.g., be) optical particle counters and/or nephelometers. Nephelometers, as the term is used herein, include both standard nephelometers that gather light scattered across a range of angles and photometers that measure scattered light at a single angle. Particle sensors may measure respective particle loads for different particle sizes or different ranges of particle sizes; the different particle sizes or ranges of particle sizes are referred to as bins.

The measured input and output particle loads are stored on a computer system and used to calculate the filtration efficiency of the air purifier. The filtration efficiency generally increases as O decreases with respect to I and generally decreases as O increases with respect to I, where O is the output particle load (e.g., for a particular bin) and I is the input particle load (e.g., for the same bin). In some embodiments, the filtration efficiency is measured using a multivariable function that is monotonic in each of its variables. For example, the filtration efficiency may be measured as a monotonic function of O/I (or equivalently, I/O) or any function that is within some fraction (e.g., 30%) of some monotonic function of O/I (i.e., a function for which each value differs from a corresponding value of the monotonic function by no more than the fraction of the corresponding value). The filtration efficiency thus may be measured as a monotonic function of the ratio of an output particle load to an input particle load. In one example, the filtration efficiency may be measured as 1−O/I. In this example, if the output particle load is zero, complete filtering is achieved and the filtration efficiency is 1 (i.e., 100%). If the output particle load equals the input particle load, no filtering has occurred and the filtration efficiency is zero. Other filtration-efficiency formulas (e.g., with the same or different upper and lower bounds corresponding to complete filtering and no filtering) are possible. For example, values of a filtration-efficiency formula may increase with increasing filtration efficiency or may decrease with increasing filtration efficiency. If the filtration efficiency becomes too low, the computer system transmits and/or displays an alert indicating that the air purifier is not functioning properly and needs maintenance.

The values of O and I used to calculate the filtration efficiency may be individual respective measurements taken by the one or more particle sensors, or may be respective averages (e.g., means, geometric means, mean squares) or other statistical functions of multiple measurements (e.g., a function that is monotonic in each of the multiple measurements or a function that is within a fraction (e.g. 30%) of some function that is monotonic in each of the multiple measurements) taken by the one or more particle sensors (e.g., during a specified period of time). Using individual respective measurements may include using single individual respective measurements (i.e., a single measurement of O and a single measurement of I) or using multiple respective measurements (e.g., calculating multiple ratios of O/I using respective single measurements taken successively during a specified period of time, and then combining (e.g., averaging) the multiple ratios).

FIG. 1 shows a system 100 with an air purifier 102, a single particle sensor 126, and a computer system 128 communicatively coupled to the particle sensor 126, in accordance with some embodiments. The air purifier 102 includes one or more filters 104 and a fan 106. In some embodiments, the one or more filters include a pre-filter and a main filter. The filter(s) 104 and fan 106 are disposed between the input 108 and the output 112 of the air purifier 102. The fan 106 sucks air 110 into the air purifier 102 through the input 108, causes the air 110 to flow through the filter(s) 104, and blows the air 110 out of the output of the air purifier 102. In the example of FIG. 1, the fan 106 is downstream (with respect to the flow of the air 110) from the filter(s) 104. Alternatively, the fan 106 and filter(s) 104 may have a different arrangement. For example, the fan 106 may be situated upstream (with respect to the flow of the air 110) from the filter(s) 104. In some embodiments, the input 108 is on a different side (e.g., an opposite side) of the air purifier from the output 112. The input 108 and/or output 112 may have multiple sections at different locations on the air purifier 102 (e.g., with each section on a respective side of the air purifier 102).

In some embodiments, the air purifier 102 is portable. Other examples of the air purifier 102 include, without limitation, a non-portable air purifier in a building (e.g., home) or car. For example, the air purifier 102 may be part of a heating, ventilation, and air conditioning (HVAC) system for a building (e.g., home) or car.

In some embodiments, the particle sensor 126 is an optical particle sensor. For example, the particle sensor 126 is an optical particle counter or a nephelometer.

The system 100 also includes a valve 118 that selectively provides air 110 from the input 108 or the output 112 to the particle sensor 126, to allow the particle sensor 126 to measure both input particle loads at the input 108 and output particle loads at the output 112. The valve 118 has a first input 120, a second input 122, and an output 124. A first tube 114 provides air 110 from the input 108 to the first input 120 of the valve 118. A second tube 116 provides air 110 from the output 112 to the second input 122 of the valve 118. The output 124 of the valve 118 is connected to the particle sensor 126. Depending on its setting, the valve 124 provides air 110 from either its first input 120 or its second input 122, and thus from either the input 108 or the output 112 of the air purifier 102, to the particle sensor 126. The first tube 114 and valve 118 couple the particle sensor 126 to the input 108. The second tube 116 and the valve 118 couple the particle sensor 126 to the output 112. The setting of the valve 118 may be controlled by the computer system 128.

The computer system 128 includes a display 129, one or more processors 130 (e.g., a microcontroller), memory 132, and transceiver 134 (e.g., wireless transceiver). These components may be communicatively coupled to each other and to the particle sensor 126 (e.g., through one or more communication busses). The memory 132 is shown separately from the processor(s) 130, but all or a portion of the memory 132 may be embedded in the processor(s) 130. The memory 132 (e.g., a non-transitory computer-readable medium, such as non-volatile memory, in the memory 132) stores instructions for execution by the processor(s) 130 to achieve the functionality of the computer system 128. The particle sensor 126 is shown as being separate from the computer system 128, but may be considered part of the computer system 128.

If the computer system 128 determines that the filtration efficiency of the air purifier 102 does not satisfy (e.g., is less than, or less than or equal to) a threshold efficiency value, the computer system 128 generates an alert. The alert may report the filtration efficiency and/or instruct a user that the air purifier 102 needs maintenance. The alert may be displayed on the display 129 and/or transmitted through one or more networks 136 to a remote computer system 138. In some embodiments, the remote computer system 138 is the user's computer system (e.g., a mobile computing device for the user), which displays the alert. Alternatively, the remote computer system 138 is a server that forwards the alert to a computer system (e.g., a mobile computing device) for the user.

FIG. 1 shows the tubes 114 and 116, valve 118, particle sensor 126, and computer system 128 as being separate from the air purifier 102. For example, the tubes 114 and 116, valve 118, particle sensor 126, and/or computer system 128 are parts of a kit that may be coupled to the air purifier 102 to allow operation of the air purifier 102 to be monitored. Alternatively, the tubes 114 and 116, valve 118, particle sensor 126, and/or computer system 128 may be integrated into the air purifier 102, such that they are part of the air purifier 102 (e.g., with the display 129 on the outside of the air purifier 102).

Figure 2:
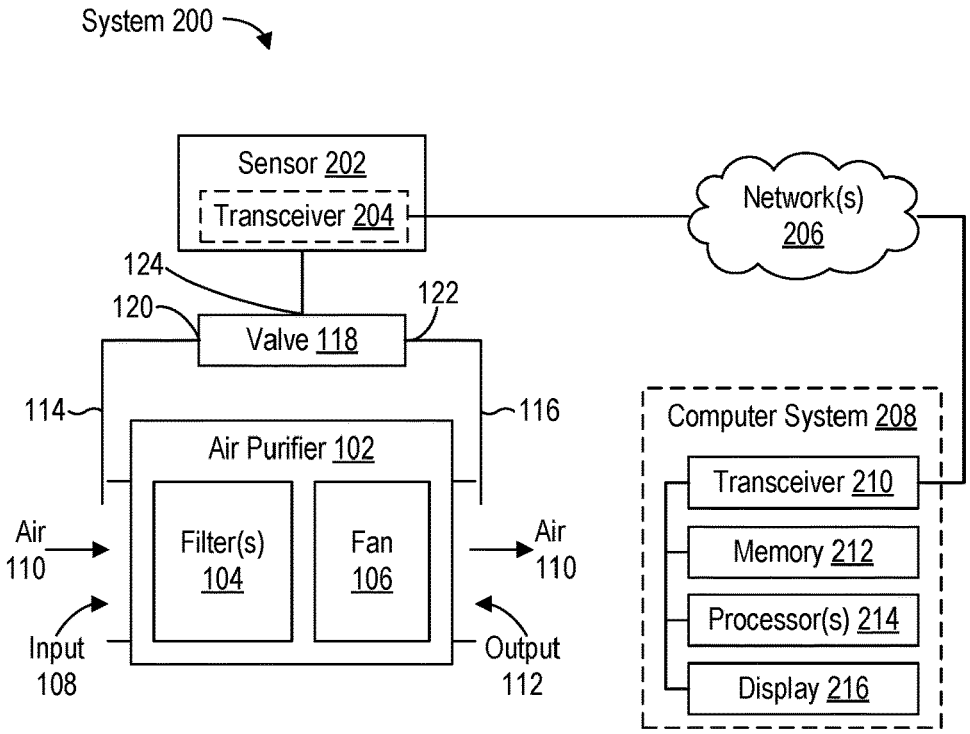
FIG. 2 shows a system with an air purifier, a valve, a single particle sensor, and a remote computer system, in accordance with some embodiments.

In the system 100, the computer system 128 is a local computer system with respect to the air purifier 102 and particle sensor 126. FIG. 2 shows an alternative system 200 in which operation of the air purifier 102 is monitored using a remote computer system 208, in accordance with some embodiments. In the system 200, the particle sensor 126 is replaced with a particle sensor 202, which includes a transceiver 204 (e.g., a wireless transceiver). Input particle loads and output particle loads measured by the particle sensor 202 are transmitted by the transceiver 204 through one or more networks 206 to the remote computer system 208, which calculates the filtration efficiency of the air purifier 102 using the input and output particle loads. The computer system 208 is remote with respect to the air purifier 102, valve 118, and particle sensor 202.

The computer system 208 includes a transceiver 210, memory 212, one or more processors 214 (e.g., a central processing unit (CPU)), and display 216. These components may be communicatively coupled to each other through one or more communication busses. The transceiver 210 receives communications directed to the computer system 208 via the one or more networks 206, including communications from the particle sensor 202 providing measured input and output particle loads for the air purifier 102. The memory 212 is shown separately from the processor(s) 214, but all or a portion of the memory 212 may be embedded in the processor(s) 214. The memory 212 (e.g., a non-transitory computer-readable medium, such as non-volatile memory, in the memory 212) stores instructions for execution by the processor(s) 214 to achieve the functionality of the computer system 208.

If the computer system 208 determines that the filtration efficiency of the air purifier 102 does not satisfy (e.g., is less than, or less than or equal to) the threshold efficiency value, the computer system 208 generates an alert. The alert may report the filtration efficiency and/or instruct a user that the air purifier 102 needs maintenance. The alert may be displayed on the display 216 and/or transmitted to another remote computer system. In some embodiments, the remote computer system 208 is the user's computer system (e.g., a mobile computing device for the user), which displays the alert on the display 216. Alternatively, the remote computer system 208 is a server that forwards the alert to another remote computer system (e.g., a mobile computing device) for the user.

FIG. 2 shows the tubes 114 and 116, valve 118 and particle sensor 202 as being separate from the air purifier 102. For example, the tubes 114 and 116, valve 118, and/or particle sensor 202 are parts of a kit that may be coupled to the air purifier 102 to allow operation of the air purifier 102 to be monitored. Alternatively, the tubes 114 and 116, valve 118, and/or particle sensor 202 may be integrated into the air purifier 102, such that they are part of the air purifier 102.

Figure 3:
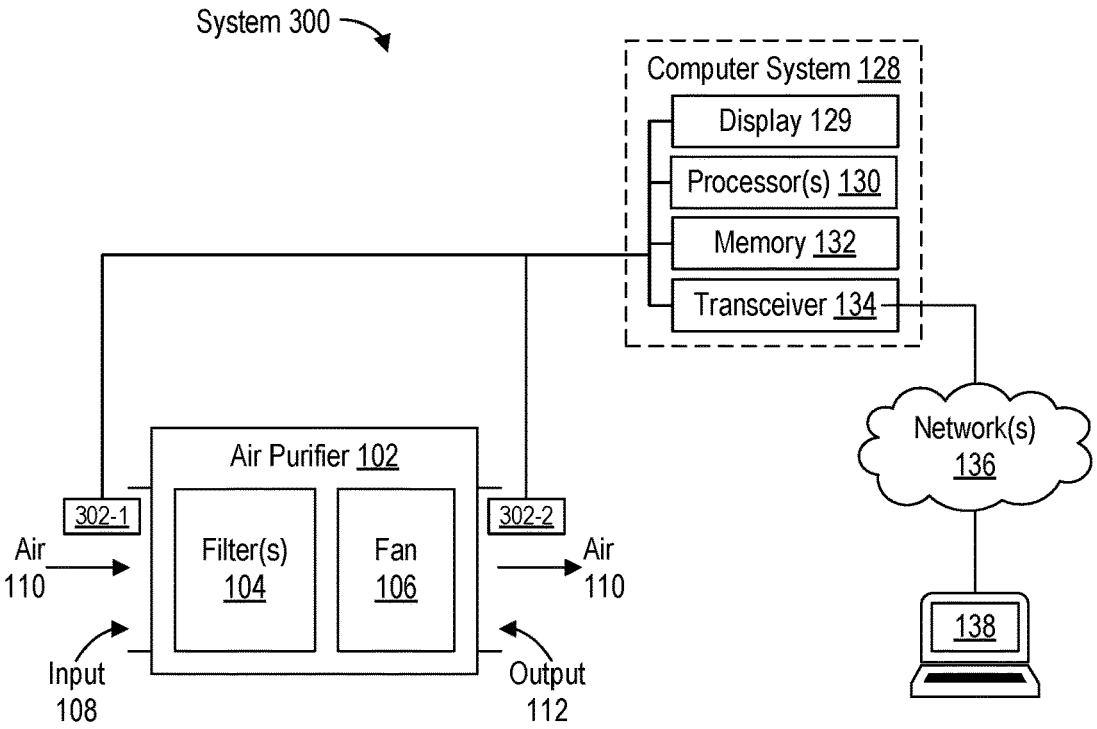
FIG. 3 shows a system with an air purifier, two particle sensors, and a computer system communicatively coupled to the two particle sensors, in accordance with some embodiments.
Figure 4:
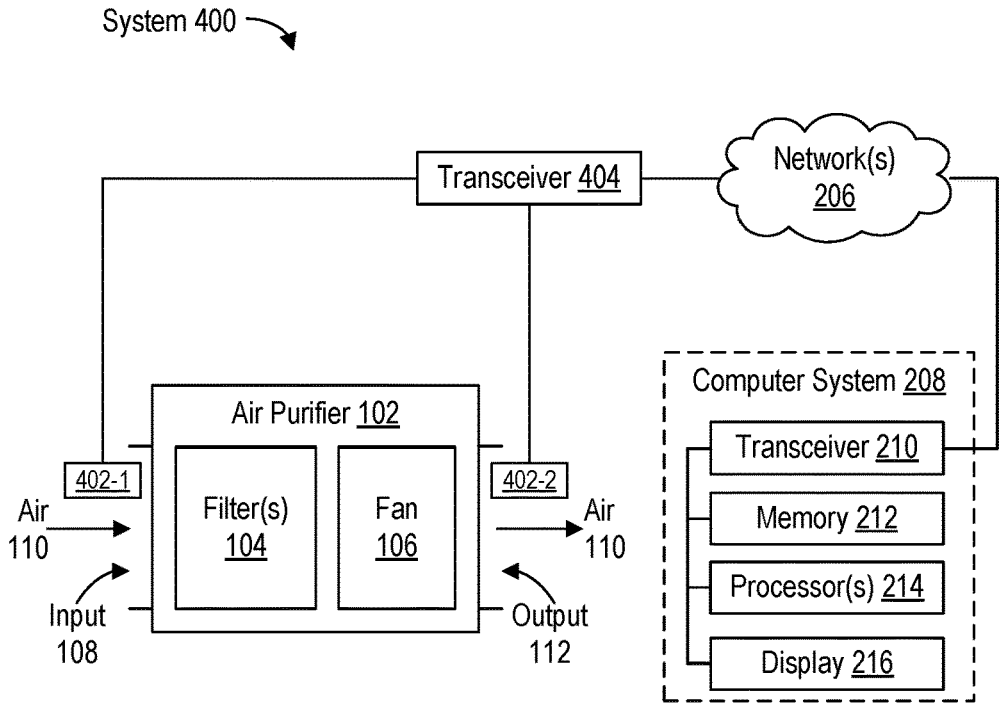
FIG. 4 shows a system with an air purifier, two particle sensors, and a remote computer system, in accordance with some embodiments.

In the examples of FIGS. 1 and 2, a single particle sensor 126 (FIG. 1) or 202 (FIG. 2) is used to measure input and output particle loads for the air purifier 102. FIGS. 3 and 4 show alternative systems 300 and 400 in which separate particle sensors are respectively used to measure input particle loads and output particle loads for the air purifier 102, in accordance with some embodiments.

FIG. 3 shows a system 300 that is similar to the system 100 (FIG. 1), but with the valve 118 eliminated and the particle sensor 126 being replaced by a first particle sensor 302-1 and a second particle sensor 302-2, in accordance with some embodiments. The first and second particle sensors 302-1 and 302-2 may be optical particle sensors (e.g., optical particle counters or nephelometers). The first particle sensor 302-1 is positioned at the input 108 of the air purifier 102 to measure input particle loads in the air 110 at the input 108. (Alternatively, a first tube couples the first particle sensor 302-1 to the input 108 to provide air 110 from the input 108 to the first particle sensor 302-1.) The second particle sensor 302-2 is positioned at the output 112 of the air purifier 102 to measure output particle loads in the air 110 at the output 112. (Alternatively, a second tube couples the second particle sensor 302-2 to the output 112 to provide air 110 from the output 112 to the second particle sensor 302-2.)

The computer system 128 (FIG. 1) is communicatively coupled to the first and second particle sensors 302-1 and 302-2 (e.g., through one or more communication busses). The first and second particle sensors 302-1 and 302-2 are shown as being separate from the computer system 128, but may be considered part of the computer system 128. The computer system 128 determines the filtration efficiency for the air purifier 102 using input particle loads measured by the first particle sensor 302-1 and output particle loads measured by the second particle sensor 302-2. If the computer system 128 determines that the filtration efficiency does not satisfy the threshold efficiency value, the computer system 128 generates an alert, as described for the system 100 (FIG. 1).

In the system 300, the computer system 128 is a local computer system with respect to the air purifier 102 and the first and second particle sensors 302-1 and 302-2. FIG. 4 shows an alternative system 400 in which operation of the air purifier 102 is monitored using the remote computer system 208 (FIG. 2), in accordance with some embodiments. In the system 400, the first particle sensor 302-1 is replaced with a first particle sensor 402-1 positioned at the input 108 and the second particle sensor 302-2 is replaced with a second particle sensor 402-2 positioned at the output 112. (Alternatively, the first particle sensor 402-1 and the second particle sensor 402-2 are respectively coupled to the input 108 and the output 112 through respective tubes.) The first particle sensor 402-1 and the second particle sensor 402-2 have an associated transceiver 404 (e.g., a wireless transceiver). (Alternatively, the first particle sensor 402-1 and the second particle sensor 402-2 each includes its own transceiver 404.) Input particle loads measured by the first particle sensor 402-1 and output particle loads measured by the second particle sensor 402-2 are respectively transmitted by the transceiver 404 through the one or more networks 206 to the remote computer system 208. The remote computer system 208 calculates the filtration efficiency using the input and output particle loads and generates alerts, as described for the system 200 (FIG. 2). The computer system 208 is remote with respect to the air purifier 102 and particle sensors 402-1 and 402-2.

FIG. 3 shows the first particle sensor 302-1, second particle sensor 302-2, and computer system 128 as being separate from the air purifier 102. Similarly, FIG. 4 shows the first particle sensor 402-1, second particle sensor 402-2, and transceiver 404 as being separate from the air purifier 102. For example, the first particle sensor 302-1, second particle sensor 302-2, and/or computer system 128 (FIG. 3) or the first particle sensor 402-1, second particle sensor 402-2, and/or transceiver 404 (FIG. 4) are parts of a kit that may be coupled to the air purifier 102 to allow operation of the air purifier 102 to be monitored. Alternatively, the first particle sensor 302-1, second particle sensor 302-2, and/or computer system 128 (FIG. 3) or the first particle sensor 402-1, second particle sensor 402-2, and/or transceiver 404 (FIG. 4) may be integrated into the air purifier 102, such that they are part of the air purifier 102 (e.g., with the display 129 (FIG. 3) on the outside of the air purifier 102).

The extent to which filtration efficiency for air purifiers degrades over time may vary by manufacturer and thus by brand. For example, an experiment in which two different brands of HEPA (high efficiency particulate air) filters (HEPA #1 and HEPA #2) were operated in 11 different rooms of a building revealed that, after several months of operation, three of the HEPA #1 filters showed degraded filtration efficiency below a threshold of 90%, whereas none of the HEPA #2 filters did. Filtration efficiency for different air purifiers of the same make and model may also vary. For example, in a second experiment, two different HEPA air purifiers of the same make and model were found to have respective filtration efficiencies of 77% and 44%. The systems 100, 200, 300, and 400 (FIGS. 1-4) solve the problem of varying filter efficiencies by allowing those air purifiers 102 with significant filter-efficiency degradation to by identified and repaired (e.g., cleaned) or replaced.

In the systems 300 and 400, the two particle sensors 302-1 and 302-2 (FIG. 3) or 402-1 and 402-2 (FIG. 4) may have varying sensitivities. For example, an experiment was performed in which simultaneous measurements were taken for two optical particle counters of the same make and model with inputs adjacent to each other. The first optical particle counter measured 6244 particles per liter for a particle size of 0.7 μm (i.e., for its 0.7 μm bin), whereas the second optical particle counter measured 2937 particles per liter for its 0.7 μm bin.

To account for this varying sensitivity between particle sensors, the two particle sensors 302-1 and 302-2 (FIG. 3) or 402-1 and 402-2 (FIG. 4) may be calibrated to each other. This calibration may be performed initially (e.g., when first setting up the air purifier 102 or immediately after performing maintenance on the air purifier 102), before subsequent use of the air purifier 102. In some embodiments, this calibration includes determining a scale factor S representing a difference in particle detection between the first particle sensor and the second particle sensor. The scale factor S is determined by taking a ratio of particle loads detected by the two particle sensors under conditions in which the particle loads for the two particle sensors should be identical. For example, the fan 106 may be turned off and the particle loads measured after waiting a period of time to allow air at the input 108 and output 112 to mix. In another example, the user removes the filter(s) 104; the particle loads are then measured with the fan 106 running. The particle load detected by the first particle sensor 302-1 or 402-1 is labelled $I_0$ and the particle load detected by the second particle sensor 302-2 or 402-2 is labelled $O_0$. ($O_0$ and $I_0$ are distinct from subsequently measured values of O and I used to determine filtration efficiency.) The scale factor S may be defined as $S=I_0/O_0$, in which case the filtration efficiency, as determined at a later point in time, may be measured as a monotonic function of S*O/I (e.g., equals 1−(S*O/I)). Or the scale factor S may be defined as $S=O_0/I_0$, in which case the filtration efficiency, as determined at a later point in time, may be a monotonic function of O/S*I (e.g., equals 1−(O/S*I)). The scale factor S is stored in the memory 132 (FIGS. 1 and 3) or 212 (FIGS. 2 and 4) for use when subsequently calculating the filtration efficiency of the air purifier 102.

In some embodiments, instead of performing calibration, initial input and output particle loads are measured (e.g., when first starting to use the air purifier 102 or after installing new filter(s) 104) and stored in the memory 132 (FIGS. 1 and 3) or 212 (FIGS. 2 and 4). The initial input and output particle loads, as stored, are used when subsequently calculating the filtration efficiency (e.g., by calculating the scale factor S and then calculating the efficiency filtration accordingly).

In some embodiments, the threshold efficiency value is determined relative to an initial filtration efficiency for the air purifier 102 (e.g., as determined upon first operating the air purifier 102 or immediately after performing maintenance on the air purifier 102). For example, the threshold efficiency value may be defined as a preset percentage of the initial filtration efficiency. Alternatively, the threshold efficiency value is a preset absolute threshold (i.e., a preset value independent of the initial filtration efficiency).

Figure 5:
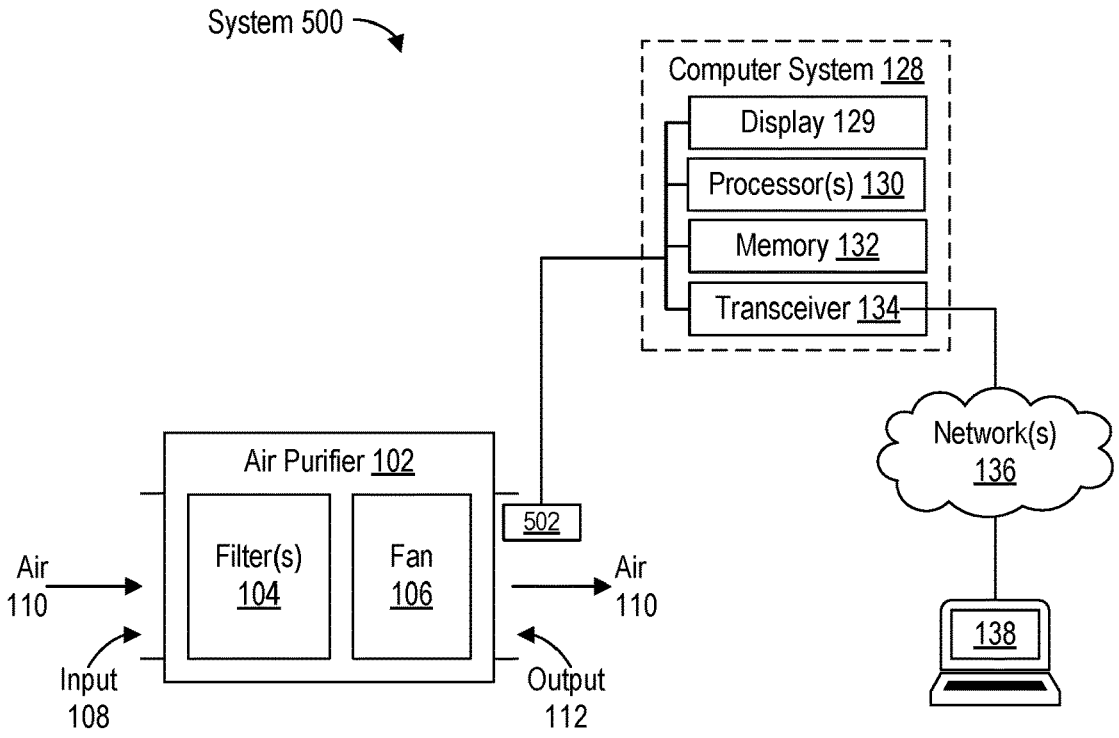
FIG. 5 shows a system with an air purifier, an anemometer, and a computer system communicatively coupled to the anemometer, in accordance with some embodiments.

Operation of an air purifier 102 can be monitored and alerts can be generated based on airflow through the air purifier 102 (e.g., output airspeed or input airspeed of the air purifier 102) in addition to or as an alternative to the filtration efficiency of the air purifier 102. FIG. 5 shows a system 500 with an air purifier 102, an anemometer 502, and the computer system 128 (FIGS. 1 and 3). The anemometer is positioned at the output 112 (or the input 108) of the air purifier 102 to measure the airspeed of the air 110 at the output 112 (or the input 108). (Alternatively, a tube couples the output 112 or the input 108 of the air purifier 102 to the anemometer 502 to provide air 110 from the output 112 or the input 108 to the anemometer 502.) The anemometer 502 is communicatively coupled to the computer system 128 (e.g., through one or more communication busses). The anemometer 502 is shown as being separate from the computer system 128, but may be considered part of the computer system 128.

If the computer system 128 determines that the airspeed does not satisfy (e.g., is less than, or less than or equal to) a threshold airspeed value, the computer system 128 generates an alert. In some embodiments, determining whether the airspeed satisfies the threshold airspeed value includes comparing a value of the airspeed measured by the anemometer to the threshold airspeed value. In some other embodiments, determining whether the airspeed satisfies the threshold airspeed value includes combining multiple values of the airspeed as measured by the anemometer (e.g., averaging or otherwise applying a statistical function to the values) and comparing the combined values (e.g., the average or value of another statistical function) to a threshold. In still other embodiments, determining whether the airspeed satisfies the threshold airspeed value includes calculating a value of a function using one or more measurements of the airspeed from the anemometer and comparing the calculated value to a threshold. The function may be, for example, a monotonic function of the airspeed as measured by the anemometer 502 or a function that is within some fraction (e.g., 30%) of some monotonic function of the airspeed as measured by the anemometer 502.

The alert may report the airspeed and/or instruct a user that the air purifier 102 needs maintenance. The alert may be displayed on the display 129 and/or transmitted through one or more networks 136 to a remote computer system 138. In some embodiments, the remote computer system 138 is the user's computer system (e.g., a mobile computing device for the user), which displays the alert. Alternatively, the remote computer system 138 is a server that forwards the alert to a computer system (e.g., a mobile computing device) for the user.

FIG. 5 shows the anemometer 502 and computer system 128 as being separate from the air purifier 102. For example, the anemometer 502 and/or computer system 128 are parts of a kit that may be coupled to the air purifier 102 to allow operation of the air purifier 102 to be monitored. Alternatively, the anemometer 502 and/or computer system 128 may be integrated into the air purifier 102, such that they are part of the air purifier 102 (e.g., with the display 129 on the outside of the air purifier 102).

Figure 6:
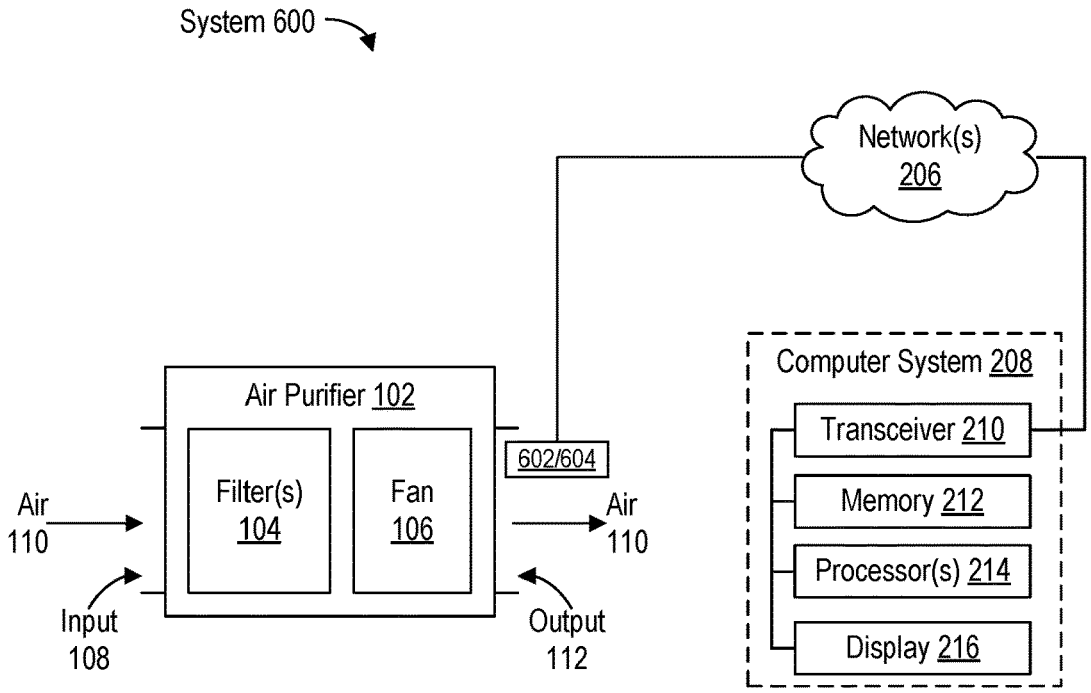
FIG. 6 shows a system with an air purifier, an anemometer, and a remote computer system, in accordance with some embodiments.

In the system 500, the computer system 128 is a local computer system with respect to the air purifier 102 and anemometer 502. FIG. 6 shows an alternative system 600 in which operation of the air purifier 102 is monitored using the remote computer system 208 (FIGS. 2 and 4), in accordance with some embodiments. In the system 200, the anemometer 502 is replaced with an anemometer 602 positioned at the output 112 (or the input 108) of the air purifier 102 to measure the airspeed of the air 110 at the output 112 (or the input 108). (Alternatively, a tube couples the output 112 or the input 108 of the air purifier 102 to the anemometer 602 to provide air 110 from the output 112 or the input 108 to the anemometer 602.) The anemometer 602 includes a transceiver 604 (e.g., a wireless transceiver). Airspeeds as measured by the anemometer 602 are transmitted by the transceiver 604 through the one or more networks 206 to the remote computer system 208, which monitors the airspeeds. The computer system 208 is remote with respect to the air purifier 102 and anemometer 602.

If the computer system 208 determines that an airspeed measured by anemometer 602 does not satisfy (e.g., is less than, or less than or equal to) a threshold air speed value, the computer system 208 generates an alert. The computer system 208 may make this determination in any of the ways described for the computer system 128 for FIG. 5. The alert may report the airspeed and/or instruct a user that the air purifier 102 needs maintenance. The alert may be displayed on the display 216 and/or transmitted to another remote computer system. In some embodiments, the remote computer system 208 is the user's computer system (e.g., a mobile computing device for the user), which displays the alert on the display 216. Alternatively, the remote computer system 208 is a server that forwards the alert to another remote computer system (e.g., a mobile computing device) for the user.

FIG. 6 shows the anemometer 602 as being separate from the air purifier 102. For example, the anemometer 602 is part of a kit that may be coupled to the air purifier 102 to allow operation of the air purifier 102 to be monitored. Alternatively, the anemometer 602 may be integrated into the air purifier 102, such that it is part of the air purifier 102.

In some embodiments, the threshold airspeed value is determined relative to an initial airspeed for the air purifier 102 (e.g., as determined upon first operating the air purifier 102 or immediately after performing maintenance on the air purifier 102). For example, the threshold airspeed value may be defined as a preset percentage of the initial airspeed. The initial airspeed may be an initial output airspeed (e.g., if the anemometer 502/602 is positioned at or coupled to the output 112) or an initial input airspeed (e.g., if the anemometer 502/602 is positioned at or coupled to the input 108). Determining the threshold airspeed value relative to the initial airspeed for the air purifier 102 accounts for variation in airspeeds between different air purifiers 102 (e.g., from different manufacturers, or even of the same make and model). Alternatively, the threshold airspeed value is a preset absolute airspeed (i.e., a preset value independent of the initial airspeed).

FIGS. 7, 8, 9, and 10 show respective systems 700, 800, 900, and 1000 in which operation of an air purifier 102 is monitored based on both filtration efficiency and airflow, in accordance with some embodiments. The system 700 (FIG. 7) is a combination of the system 100 (FIG. 1) and the system 500 (FIG. 5). The system 800 (FIG. 8) is a combination of the system 200 (FIG. 2) and the system 600 (FIG. 6). The system 900 (FIG. 9) is a combination of the system 300 (FIG. 3) and the system 500 (FIG. 5). The system 1000 (FIG. 10) is a combination of the system 400 (FIG. 4) and the system 600 (FIG. 6). In the system 800 (FIG. 8), a transceiver 804 transmits measurement data from the particle sensor 202 and the anemometer 502 through the one or more networks 206 to the computer system 208. In the system 1000 (FIG. 10), a transceiver 1004 transmits measurement data from the first particle sensor 402-1, the second particle sensor 402-2, and the anemometer 502 through the one or more networks 206 to the computer system 208. The computer system 128 (FIGS. 7 and 9) or 208 (FIGS. 8 and 10) generates alerts based on the filtration efficiency and/or the airspeed of the air purifier 102 (e.g., as described for the systems 100-600, FIGS. 1-6).

While FIGS. 7, 8, 9, and 10 show the anemometer 502 or 602 positioned at the output 112, the anemometer 502 or 602 may alternatively be positioned at the input 108, coupled to the input 108 through a tube, or coupled to the output 112 through a tube. The particle sensors 302-1 and 302-2 (FIG. 9) or 402-1 or 402-2 (FIG. 10) may be respectively coupled to the input 108 and output 112 through respective tubes instead of being positioned at the input 108 and the output 112.

Figure 7:
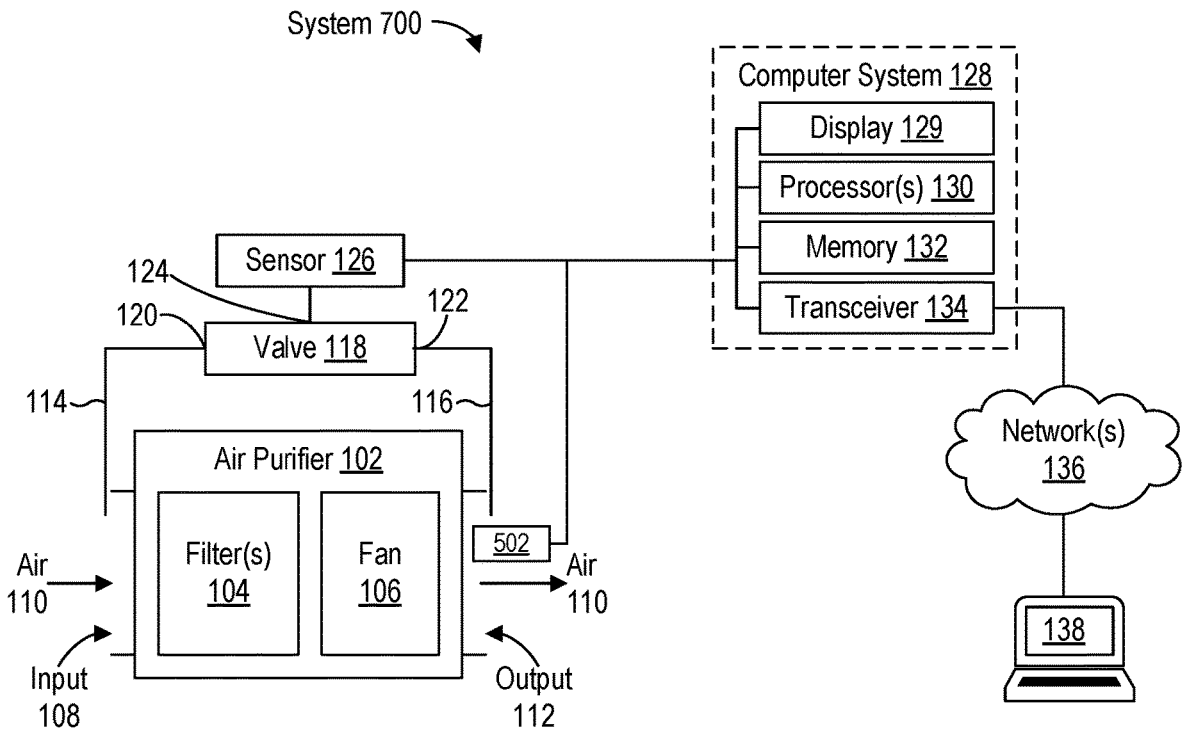
FIG. 7 shows a combination of the systems of FIGS. 1 and 5, in accordance with some embodiments.
Figure 8:
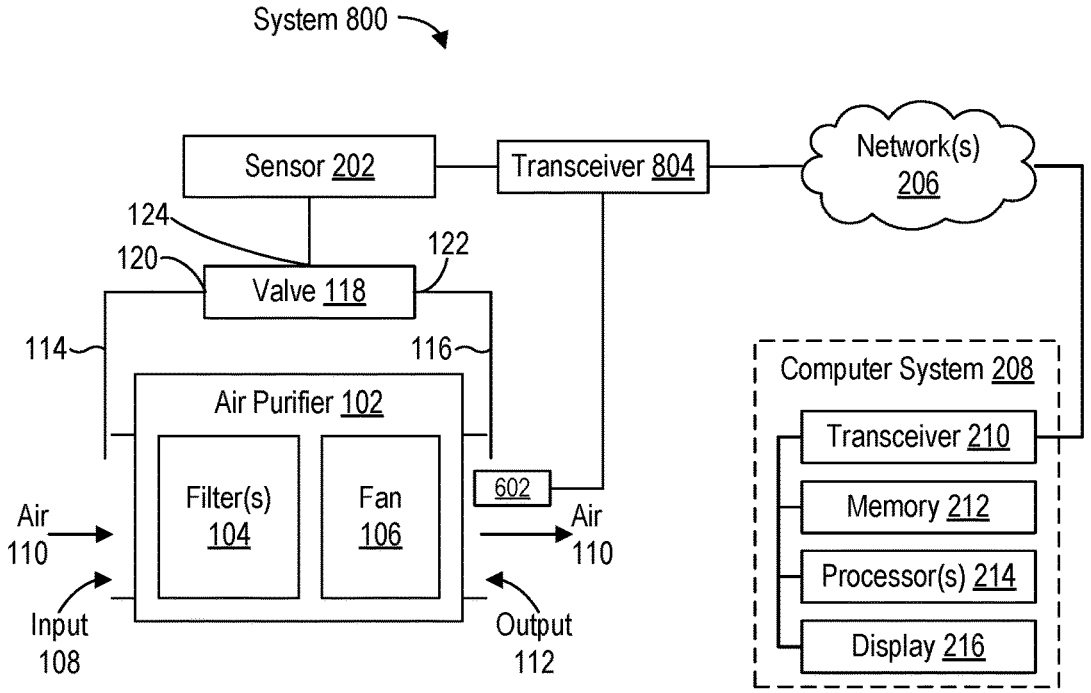
FIG. 8 shows a combination of the systems of FIGS. 2 and 6, in accordance with some embodiments.
Figure 9:
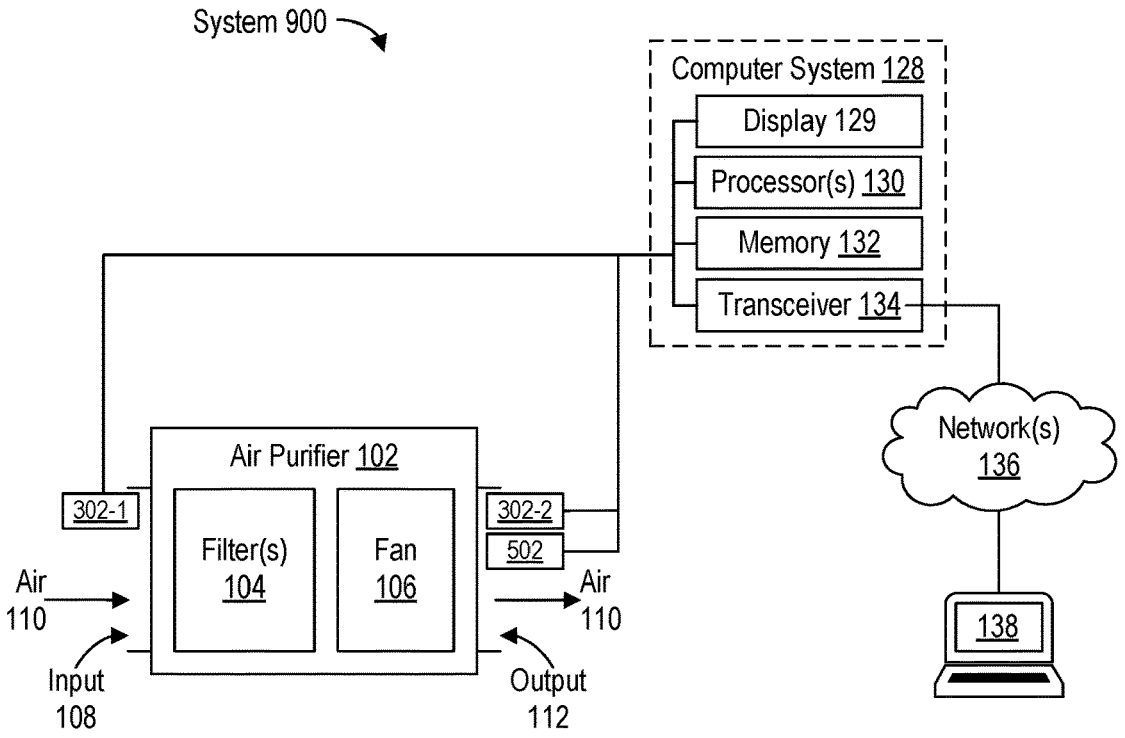
FIG. 9 shows a combination of the systems of FIGS. 3 and 5, in accordance with some embodiments.
Figure 10:
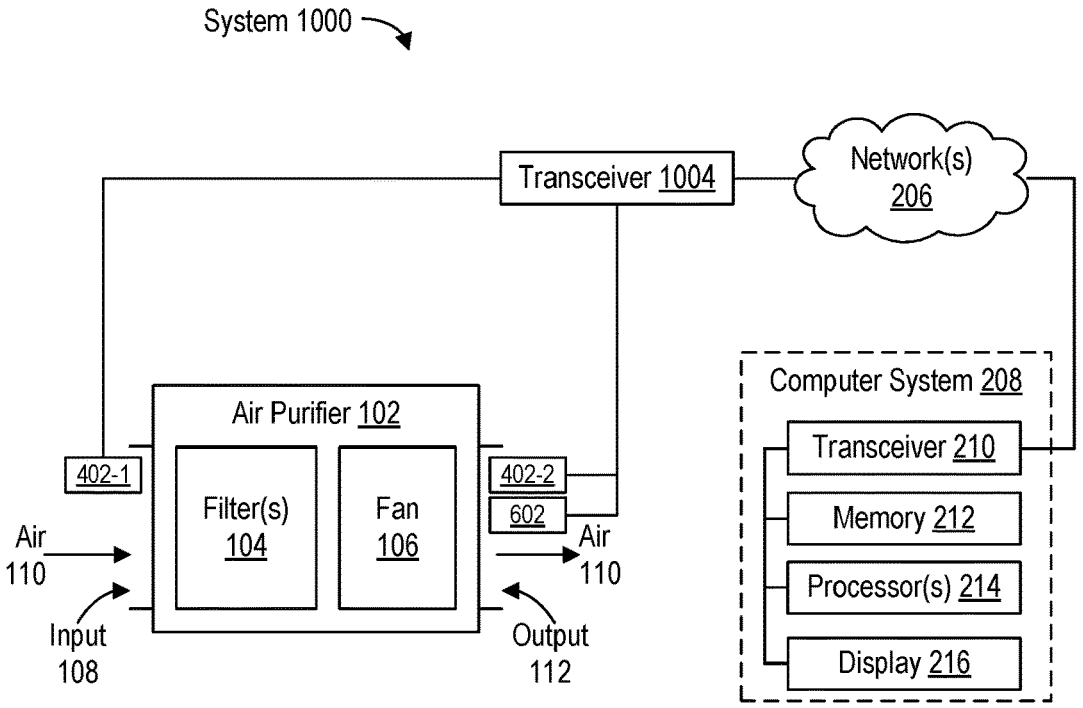
FIG. 10 shows a combination of the systems of FIGS. 4 and 6, in accordance with some embodiments.

In FIG. 7, the tubes 114 and 116, valve 118, sensor 126, anemometer 502, and/or computer system 128 may be separate from the air purifier 102 (e.g., may be parts of a kit to be coupled to the air purifier 102 to allow operation of the air purifier 102 to be monitored) or may be integrated into the air purifier 102, such that they are part of the air purifier 102 (e.g., with the display 129 on the outside of the air purifier 102). In FIG. 8, the tubes 114 and 116, valve 118, sensor 202, anemometer 602, and/or transceiver 804 may be separate from the air purifier 102 (e.g., may be parts of a kit to be coupled to the air purifier 102 to allow operation of the air purifier 102 to be monitored) or may be integrated into the air purifier 102, such that they are part of the air purifier 102. In FIG. 9, the particle sensors 302-1 and 302-2, anemometer 502, and/or computer system 128 may be separate from the air purifier 102 (e.g., may be parts of a kit to be coupled to the air purifier 102 to allow operation of the air purifier 102 to be monitored) or may be integrated into the air purifier 102, such that they are part of the air purifier 102 (e.g., with the display 129 on the outside of the air purifier 102). In FIG. 10, the particle sensors 402-1 and 402-2, anemometer 602, and/or transceiver 1004 may be separate from the air purifier 102 (e.g., may be parts of a kit to be coupled to the air purifier 102 to allow operation of the air purifier 102 to be monitored) or may be integrated into the air purifier 102, such that they are part of the air purifier 102.

Multiple redundant or complementary particle sensors may be positioned at or coupled to the input 108 and/or to the output 112 of an air purifier 102, with measurements from the multiple particle sensors being combined (e.g., averaged or otherwise combined using a statistical function) as part of determining the filtration efficiency. Similarly, multiple anemometers may be positioned at or coupled to the output 112 of an air purifier, with measurements from the multiple anemometers being combined (e.g., averaged or otherwise combined using a statistical function). Alerts may be generated based on measured particle loads and/or measured airspeeds as combined (e.g., averaged or otherwise combined using a statistical function) from multiple instruments and/or as combined (e.g., averaged or otherwise combined using a statistical function) over time.

In the examples of FIGS. 1-4 and 7-10, the systems include either two particle sensors (FIGS. 3-4 and 9-10) or a valve 118 coupled to a single sensor (FIGS. 1-2 and 7-8). In some alternative embodiments, the first particle sensor (e.g., first particle sensor 302-1, FIG. 3 or 9; first particle sensor 402-1, FIG. 4 or 10) is removed and the remaining single particle sensor (e.g., second particle sensor 302-2, FIG. 3 or 9; second particle sensor 402-2, FIG. 4 or 10) is used to measure both input and output particle loads. In other alternative embodiments, the tube 114 and valve 118 (FIG. 1, 2, 7, or 8) are removed and the single particle sensor 126 (FIG. 1 or 7) or 202 (FIG. 2 or 8) (e.g., as coupled to the output 112 by a tube), is used to measure both input and output particle loads. In these alternative embodiments, the single particle sensor measures output particle loads with the fan 106 running and measures input particle loads with the fan 106 turned off (after allowing enough time to pass after turning off the fan 106 for air at the input 108 and output 112 to equilibrate). The computer system 128 (FIG. 1, 3, 7, or 9) or 208 (FIG. 2, 4, 8, or 10) may turn the fan 106 on and off by providing corresponding commands to the fan 106, to allow these measurements to be taken. The resulting measurements are used to determine filtration efficiency, in any of the manners described above or below for the method 1100 (FIG. 11).

Figure 13:
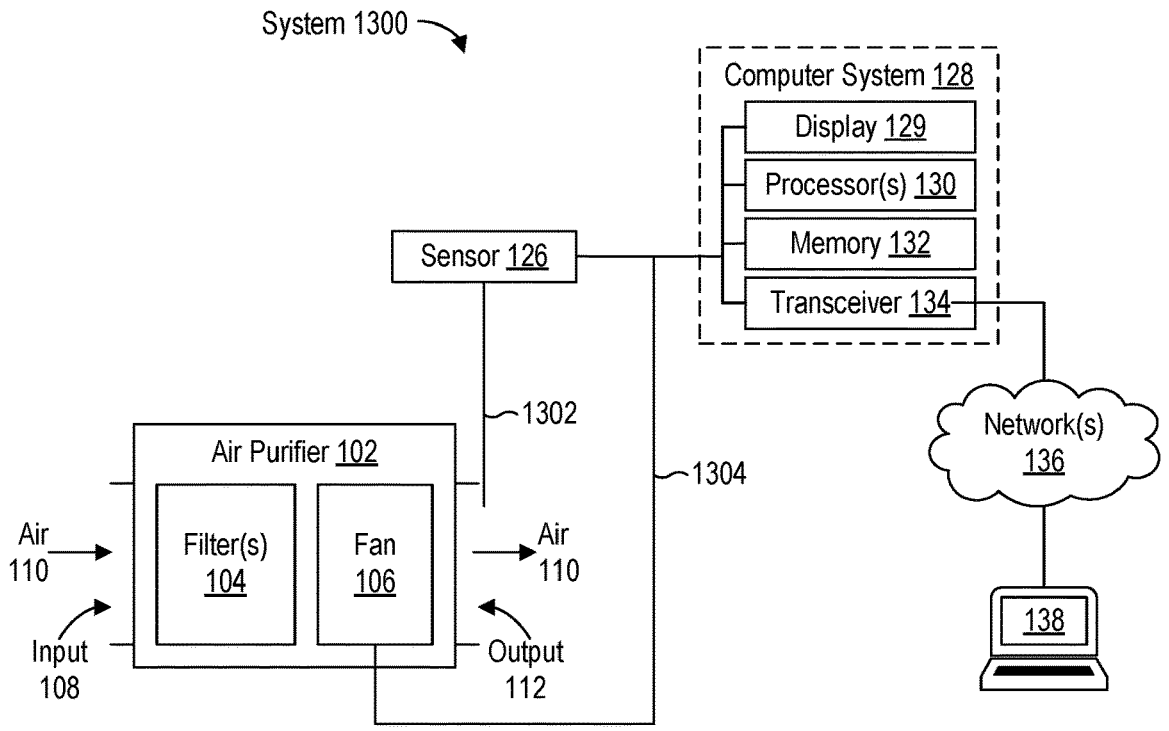
FIG. 13 shows a system with an air purifier, a single particle sensor, and a computer system communicatively coupled to the sensor and the air-purifier's fan, in accordance with some embodiments.

FIG. 13 shows a system 1300 in which the tube 114 and valve 118 of the system 100 (FIG. 1) have been removed and the tube 116 of the system 100 (FIG. 1) has been replaced with a tube 1302 that couples the sensor 126 with the output 112 to provide air from the output 112 to the sensor 126. In addition to being communicatively coupled with the sensor 128, the computer system 128 is communicatively coupled with the fan 106 (e.g., through a signal line or bus 1304). The computer system 128 may turn the fan 106 off and on by providing corresponding commands to the fan 106 (e.g., through a signal line or bus 1304), to allow input and output particle loads to be measured using the sensor 126. The memory 132 (e.g., a non-transitory computer-readable medium in the memory 132) may store instructions for execution by the processor(s) 130 for providing commands to the fan 106 to turn the fan 106 off and on.

Figure 14:
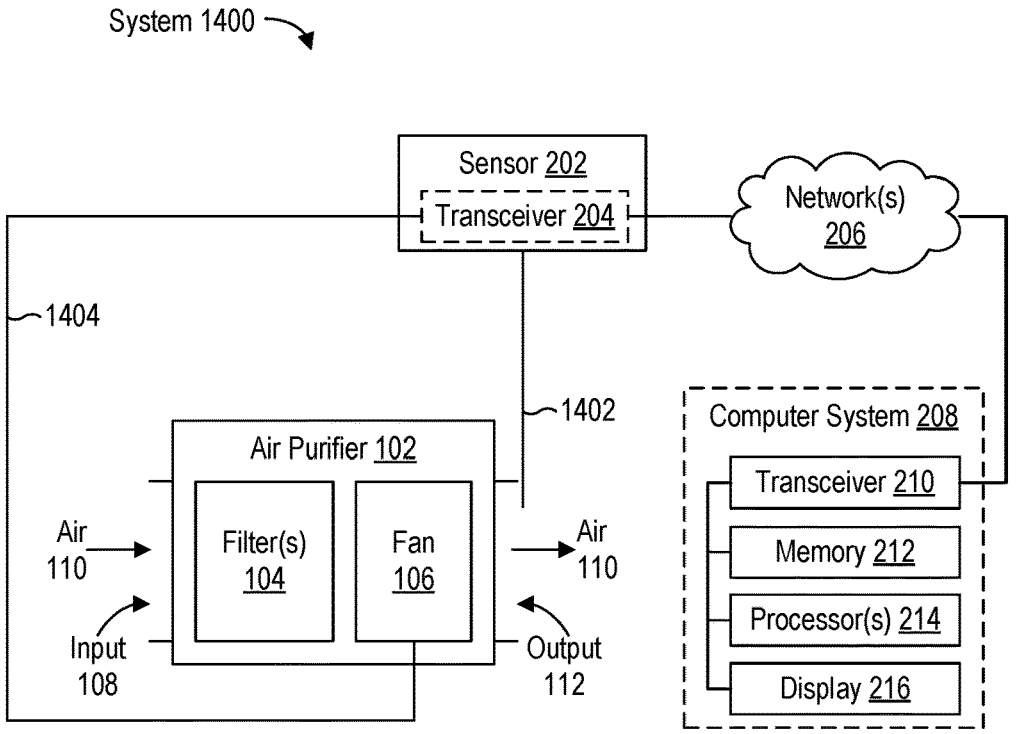
FIG. 14 shows a system with an air purifier, a single particle sensor, and a remote computer system that can remotely control the air-purifier's fan, in accordance with some embodiments.

FIG. 14 shows a system 1400 in which the tube 114 and valve 118 of the system 200 (FIG. 2) have been removed and the tube 116 of the system 200 (FIG. 2) has been replaced with a tube 1402 that couples the sensor 202 with the output 112 to provide air from the output 112 to the sensor 202. The computer system 208 may remotely turn the fan 106 off and on by providing corresponding commands to the fan 106 (e.g., through the one or more networks 206, transceiver 204, and signal line or bus 1404 that communicatively couples the transceiver 204 with the fan 106), to allow input and output particle loads to be measured using the sensor 202. The memory 212 (e.g., a non-transitory computer-readable medium in the memory 212) may store instructions for execution by the processor(s) 214 for providing commands to the fan 106 to turn the fan 106 off and on remotely.

The systems 1300 and 1400 are two examples of single-particle-sensor systems that measure input and output particle loads by turning the fan 106 off and on. Other examples (e.g., for which a valve or particle sensor is removed from the systems of FIG. 3-4 or 7-10 and a signal line or bus is added for controlling the fan 106) are possible. Alternative embodiments in which the tube 1302 is removed and the sensor 126 is positioned or coupled at the output 112 in FIG. 13 are possible. Similarly, alternative embodiments in which the tube 1402 is removed and the sensor 202 is positioned or coupled at the output 112 in FIG. 14 are possible.

Figure 11:
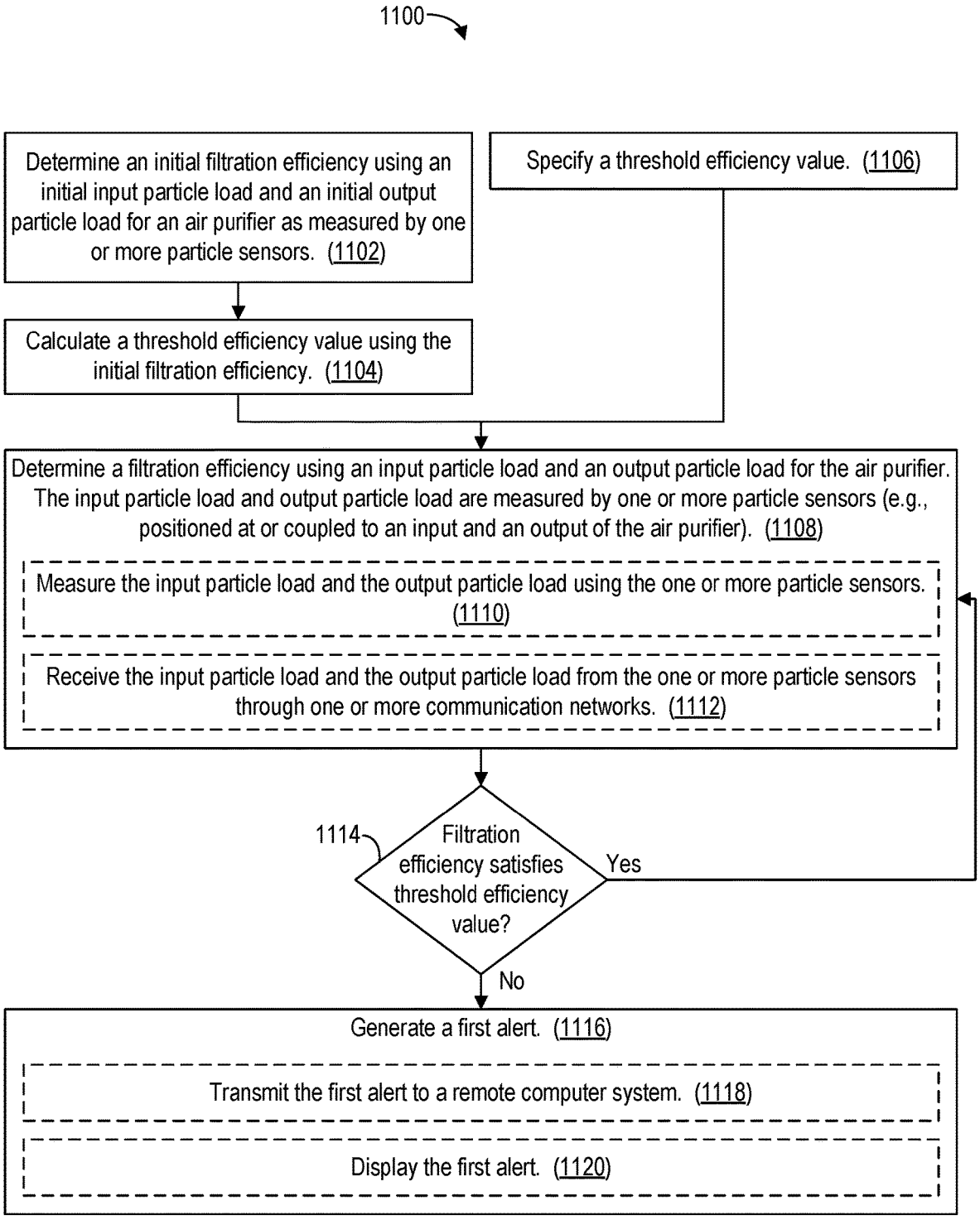
FIG. 11 is a flowchart showing a method of monitoring operation of an air purifier based on filtration efficiency, in accordance with some embodiments.

FIG. 11 is a flowchart showing a method 1100 of monitoring operation of an air purifier 102 based on filtration efficiency, in accordance with some embodiments. The method 1100 is performed at a computer system (e.g., computer system 128, FIG. 1, 3, 7, 9, or 13; computer system 208, FIG. 2, 4, 8, 10, or 14) that includes one or more processors and memory (e.g., a non-transitory computer-readable medium) storing instructions for execution by the one or more processors. The instructions include instructions for performing the method 1100.

In some embodiments of the method 1100, an initial filtration efficiency of the air purifier 102 is determined (1102) using an initial input particle load and an initial output particle load for the air purifier as measured by one or more particle sensors. A threshold efficiency value is calculated (1104) using the initial filtration efficiency. The initial input particle load and the initial output particle load may be respective individual measurements taken by the one or more particle sensors, or may be respective combinations of repeated measurements taken by the one or more particle sensors (as described below for step 1108). For example, the initial input particle load and the initial output particle load may be respective averages (e.g., means, geometric means, mean squares) or other statistical functions of the repeated measurements. The initial input particle load and an initial output particle load may be measured in the same manner as the input particle load and output particle load of step 1108 (below).

Alternatively, the threshold efficiency may be specified (1106).

As part of monitoring the air purifier 102, a filtration efficiency for the air purifier 102 is determined (1108) using an input particle load and an output particle load for the air purifier 102. The input particle load and output particle load are measured by one or more particle sensors (e.g., the one or more particle sensors of step 1102) (e.g., positioned at or coupled to an input 108 and an output 112 of the air purifier 102, or positioned at or coupled to the output 112). For example, the one or more particle sensors include (e.g., are) one or more optical particle sensors (e.g., one or more optical particle counters and/or nephelometers). In the examples of FIGS. 1-10, the input particle load is measured for air at or taken from the input 108 and the output particle load is measured for air at or taken from the output 112. Alternatively, the input particle load may be measured at one or more other locations that have effectively the same particle load as the input 108 and/or the output particle load may be measured at one or more other locations that have effectively the same particle load as the output 112, as previously discussed. In the examples of FIGS. 13-14, the input particle load is measured for air at or taken from the output 112 with the fan 106 off and the output particle load is measured for air at or taken from the output 112 with the fan 106 turned on.

The input particle load and the output particle load used to determine the filtration efficiency may be respective individual measurements taken by the one or more particle sensors, or may be respective averages (e.g., mean, geometric mean, mean square) or other statistical functions of repeated measurements taken by the one or more particle sensors. In the latter example, determining the filtration efficiency includes combining (e.g., averaging) respective repeated measurements of the input particle load and the output particle load, and calculating the filtration efficiency using respective combinations (e.g., averages) of the repeated measurements of the input particle load and the output particle load. In the former example, single individual respective measurements (i.e., a single measurement of O and a single measurement of I) may be used or multiple respective measurements may be used (e.g., by calculating multiple ratios of O/I using respective single measurements taken successively during a specified period of time, and then combining (e.g., averaging) the multiple ratios).

In some embodiments, the method 1100 includes measuring (1110) the input particle load and the output particle load using the one or more particle sensors. For example, the computer system that performs the method 1100, and thus determines the filtration efficiency, is communicatively coupled (e.g., by one or more communication busses) to the one or more particle sensors and receives the input particle load and the output particle load from the one or more particle sensors. In some embodiments, the input particle load and the output particle load are received (1112) from the one or more particle sensors through one or more communication networks (e.g., communication network(s) 206, FIG. 2, 4, 8, 10, or 14).

The filtration efficiency may be determined (1108) after the threshold efficiency value has been calculated (1104) or specified (1106).

In some embodiments, the one or more particle sensors include a first particle sensor (e.g., particle sensor 126, FIG. 1 or 7; particle sensor 202, FIG. 2 or 8) that measures both the input particle load and the output particle load. A valve (e.g., valve 118, FIG. 1, 2, 7, or 8) is used to selectively provide air 110 from the input 108 or the output 112 of the air purifier 102 to the first particle sensor to allow the first particle sensor to measure the input particle load and the output particle load. In some other embodiments, the one or more particle sensors include a first particle sensor (e.g., particle sensor 126, FIG. 13; particle sensor 202, FIG. 14) that measures both the input particle load and the output particle load, and no valve 118 is present. To determine the filtration efficiency, the filtration efficiency is calculated using the input particle load as measured by the first particle sensor and the output particle load as measured by the first particle sensor.

In some embodiments, the one or more particle sensors include a first particle sensor (e.g., particle sensor 302-1, FIG. 3 or 9; particle sensor 402-1, FIG. 4 or 10) and a second particle sensor (e.g., particle sensor 302-2, FIG. 3 or 9; particle sensor 402-2, FIG. 4 or 10). The first particle sensor measures the input particle load and the second particle sensor measures the output particle load. To determine the filtration efficiency, the filtration efficiency is calculated using the input particle load as measured by the first particle sensor and the output particle load as measured by the second particle sensor. The first particle sensor and the second particle sensor may be calibrated to each other (e.g., by calculating a scale factor S, which is used to calculate the filtration efficiency). This calibration may be performed at the beginning of the method 1100 (e.g., before step 1108; before step 1102).

A determination is made (1114) as to whether the filtration efficiency satisfies (e.g., is greater than, or greater than or equal to) the threshold efficiency value. If the filtration efficiency satisfies the threshold efficiency value (1114—Yes), the method 1100 reverts to step 1108 and monitoring of the air purifier 102 continues. In response to a determination that the filtration efficiency does not satisfy (e.g., is less than, or less than or equal to) the threshold efficiency value (1114—No), however, a first alert is generated (1116).

In some embodiments, the first alert is transmitted to a remote computer system (1118). For example, the computer system that performs the method 1100, and thus that generates the first alert, is a first computer system that transmits the first alert to a second computer system (e.g., a server system; a user's computer system device) remote from the first computer system for display by the second computer system.

In some embodiments, the first alert is displayed (1120). For example, the computer system that performs the method 1100, and thus that generates the first alert, includes a display; the computer system displays the first alert on the display. The computer system may both display the first alert and transmit the first alert to a remote computer system.

Figure 12A:
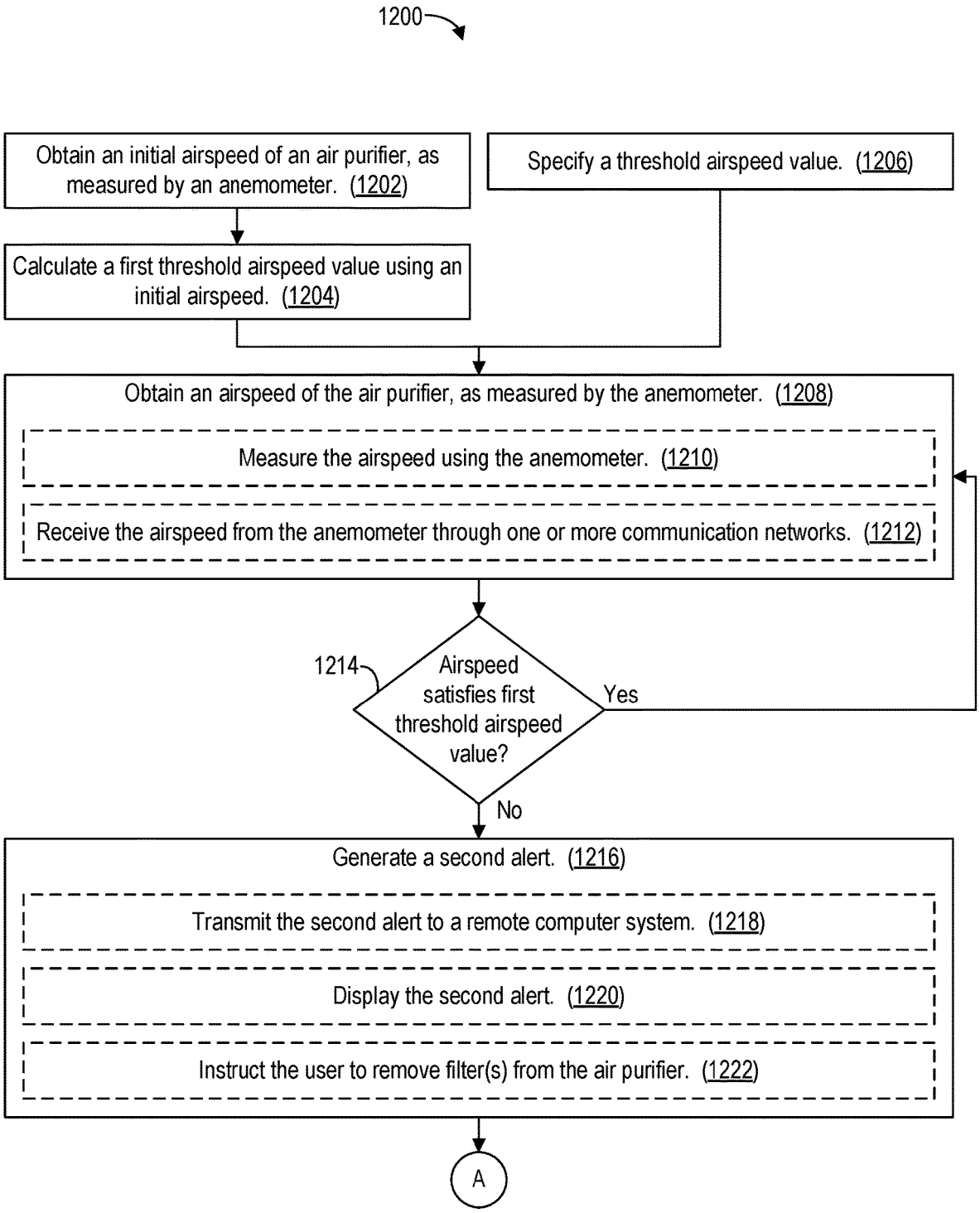
FIGS. 12A-12B are a flowchart showing a method of monitoring operation of an air purifier based on airspeed, in accordance with some embodiments.
Figure 12B:
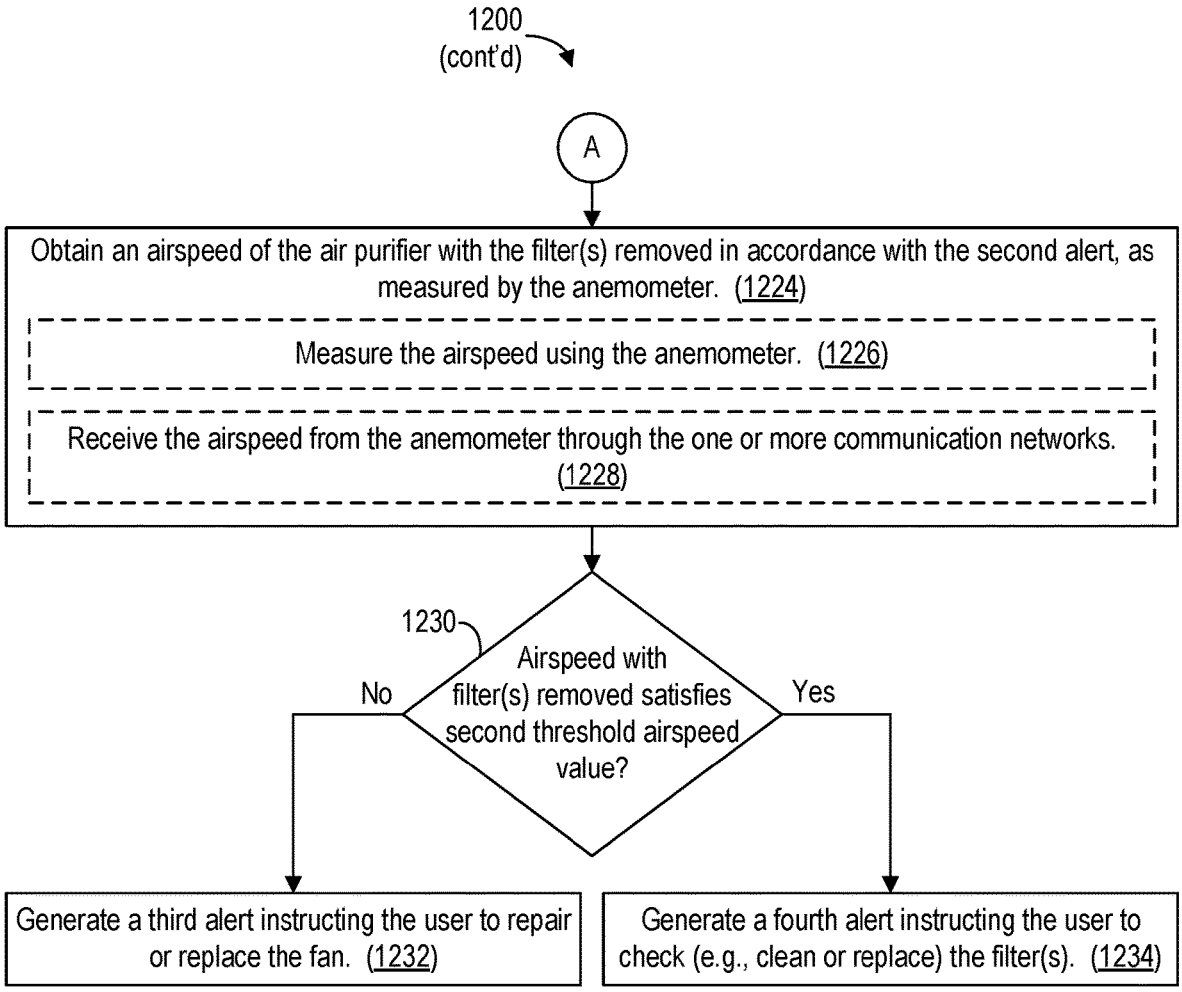

FIGS. 12A-12B are a flowchart showing a method 1200 of monitoring operation of an air purifier 102 based on airspeed, in accordance with some embodiments. The method 1200 is performed at a computer system (e.g., computer system 128, FIG. 5, 7, or 9; computer system 208, FIG. 6, 8, or 10) that includes one or more processors and memory (e.g., a non-transitory computer-readable medium) storing instructions for execution by the one or more processors. The instructions include instructions for performing the method 1200.

In some embodiments of the method 1200, an initial airspeed of the air purifier 102, as measured by an anemometer (e.g., anemometer 502, FIG. 5, 7, or 9; anemometer 602, FIG. 6, 8, or 10) is obtained (1202, FIG. 2A). The anemometer may be positioned at or coupled to the output 112 or input 108 of the anemometer; the initial airspeed may be an initial input airspeed or an initial output airspeed. A first threshold airspeed value is calculated (1204) using an initial airspeed. A second threshold airspeed (e.g., distinct from the first threshold airspeed) may also be calculated using an initial airspeed measured by the anemometer (e.g., an initial airspeed with the filter(s) 104 removed from the air purifier 102, whereas the initial airspeed used to calculate the first threshold airspeed is measured with the filter(s) 104 installed in the air purifier 102). The initial airspeed(s) may be measured upon first operating the air purifier 102 or immediately after performing maintenance on the air purifier 102. In some embodiments, the second threshold airspeed is higher than the first threshold airspeed, since the second threshold airspeed may subsequently be applied when the filter(s) 104 have been removed, per step 1230 (FIG. 12B).

Alternatively, the first threshold airspeed is specified (1206). The second threshold airspeed (e.g., distinct from, such as higher than, the first threshold airspeed) may also be specified.

An airspeed (or multiple measured airspeeds) of the air purifier 102 (e.g., at the output 112 or input 108), as measured by the anemometer, is obtained (1208). The airspeed is distinct from the initial airspeed and is obtained as part of monitoring the air purifier 102. In some embodiments, the method 1200 includes measuring (1210) the airspeed using the anemometer. For example, the computer system that performs the method 1200 is communicatively coupled to the anemometer and receives the airspeed from the anemometer. In some embodiments, the airspeed is received (1212) from the anemometer through one or more communication networks (e.g., one or more communication networks 206, FIG. 6, 8, or 10).

A determination is made (1214) as to whether the airspeed obtained in step 1208 satisfies (e.g., is greater than, or greater than or equal to) the first threshold airspeed value. If the airspeed satisfies the first threshold airspeed value (1214—Yes), the method 1200 reverts to step 1208 and monitoring of the air purifier 102 continues. In response to a determination that the airspeed does not satisfy (e.g., is less than, or less than or equal to) the first threshold airspeed value (1214—No), however, a second alert is generated (1216).

In some embodiments, determining whether the airspeed satisfies the threshold airspeed value includes comparing a value of the airspeed obtained in step 1208 to the threshold airspeed value. In some other embodiments, determining whether the airspeed satisfies the threshold airspeed value includes combining multiple values of the airspeed obtained in step 1208 (e.g., averaging or otherwise applying a statistical function to the values) and determining whether the combined values (e.g., the average or value of another statistical function) satisfy a threshold. In still other embodiments, determining whether the airspeed satisfies the threshold airspeed value includes calculating a value of a function using one or more values of the airspeed obtained in step 1208 and determining whether the calculated value of the function satisfies a threshold. The function may be, for example, a monotonic function of the airspeed as measured by the anemometer 502 or a function that is within some fraction (e.g., 30%) of some monotonic function of the airspeed as measured by the anemometer 502.

In some embodiments, the second alert is transmitted to a remote computer system (1218). For example, the computer system that performs the method 1200, and thus that generates the second alert, is a first computer system that transmits the second alert to a second computer system (e.g., a server system; a user's mobile computing device) remote from the first computer system for display by the second computer system.

In some embodiments, the second alert is displayed (1220). For example, the computer system that performs the method 1200, and thus that generates the second alert, includes a display; the computer system displays the second alert on the display. The computer system may both display the second alert and transmit the second alert to a remote computer system.

The second alert may instruct (1222) the user to remove the filter(s) 104 from the air purifier 102. An airspeed of the air purifier 102 (e.g., at the output 112 or input 108) with the filter(s) 104 removed in accordance with the second alert, as measured by the anemometer, is obtained (1224). In some embodiments, the method 1200 includes measuring (1226) this airspeed using the anemometer (e.g., with the computer system that performs the method 1200 being communicatively coupled to the anemometer and receiving the airspeed from the anemometer.) In some embodiments, the airspeed is received (1228) from the anemometer through the one or more communication networks (e.g., the one or more communication networks 206, FIG. 6, 8, or 10).

A determination is made (1230) as to whether the airspeed obtained in step 1224 satisfies (e.g., is greater than, or greater than or equal to) the second threshold airspeed value. In response to a determination that the airspeed does not satisfy (e.g., is less than, or less than or equal to) the second threshold airspeed value (1230—No), a third alert is generated (1232) instructing the user to repair or replace the fan 106. A slow airspeed even with the filter(s) 104 removed indicates a problem with the fan 106, such that it should be repaired or replaced.

In response to a determination that the airspeed satisfies the second threshold airspeed value (1230—Yes), a fourth alert is generated (1234) instructing the user to check (e.g., clean or replace) the filter(s) 104. Finding that the airspeed is satisfactory once the filter(s) 104 have been removed indicates a problem with the filter(s) 104 and not with the fan 106.

The third alert and/or fourth alert may be transmitted to a remote computer system and/or displayed (e.g., as described for the second alert).

The methods 1100 and 1200 may be combined, such that the same computer system (e.g., computer system 128, FIG. 7 or 9; computer system 208, FIG. 8 or 10) performs both methods 1100 and 1200 to monitor the same air purifier 102.

The foregoing description, for purpose of explanation, has been described with reference to specific embodiments. However, the illustrative discussions above are not intended to be exhaustive or to limit the scope of the claims to the precise forms disclosed. Many modifications and variations are possible in view of the above teachings. The embodiments were chosen in order to best explain the principles underlying the claims and their practical applications, to thereby enable others skilled in the art to best use the embodiments with various modifications as are suited to the particular uses contemplated.

What is claimed is:

1. An apparatus, comprising:

a first particle sensor to measure an input particle load for an air purifier;

a second particle sensor to measure an output particle load for the air purifier;

one or more processors coupled to the first particle sensor and the second particle sensor; and memory storing one or more programs for execution by the one or more processors, the one or more programs comprising instructions for:

calibrating the first particle sensor to the second particle sensor, comprising determining a scale factor representing a difference in particle detection between the first particle sensor and the second particle sensor;

calculating a filtration efficiency of the air purifier using the input particle load as measured by the first particle sensor, the output particle load as measured by the second particle sensor, and the scale factor;

determining whether the filtration efficiency satisfies a threshold efficiency value; and generating a first alert in response to a determination that the filtration efficiency does not satisfy the threshold efficiency value.

2. The apparatus of claim 1, wherein the filtration efficiency is calculated as a monotonic function of the ratio of the output particle load to the input particle load.

3. The apparatus of claim 1, wherein:

the first particle sensor is to repeatedly measure the input particle load;

the second particle sensor is to repeatedly measure the output particle load; and the instructions for calculating the filtration efficiency comprise instructions for:

combining respective repeated measurements of the input particle load and the output particle load, and calculating the filtration efficiency using respective combinations of the repeated measurements of the input particle load and the output particle load.

4. The apparatus of claim 1, wherein:

the first particle sensor is to repeatedly measure the input particle load;

the second particle sensor is to repeatedly measure the output particle load; and the instructions for calculating the filtration efficiency comprise instructions for:

calculating ratios of the output particle load to the input particle load using respective repeated measurements of the input particle load and the output particle load, combining the ratios, and calculating the filtration efficiency using the combined ratios.

5. The apparatus of claim 1, wherein the one or more programs further comprise instructions for:

before calculating the filtration efficiency and determining whether the filtration efficiency satisfies the threshold efficiency value, determining an initial filtration efficiency of the air purifier using an initial input particle load for the air purifier as measured by the first particle sensor and an initial output particle load for the air purifier as measured by the second particle sensor; and calculating the threshold efficiency value using the initial filtration efficiency.

6. The apparatus of claim 1, further comprising a transceiver coupled to the memory and the one or more processors, wherein the instructions for generating the first alert comprise instructions for transmitting the first alert through the transceiver to a remote computer system.

7. The apparatus of claim 1, further comprising a display coupled to the memory and the one or more processors, wherein the instructions for generating the first alert comprise instructions for displaying the first alert on the display.

8. The apparatus of claim 1, further comprising an anemometer to measure an airspeed of the air purifier, wherein the one or more programs further comprise instructions for:

determining whether the airspeed satisfies a first threshold airspeed value; and generating a second alert in response to a determination that the airspeed does not satisfy the first threshold airspeed value.

9. The apparatus of claim 8, wherein:

the anemometer is to repeatedly measure the airspeed; and the instructions for determining whether the airspeed satisfies the first threshold airspeed value comprise instructions for:

combining repeated measurements of the airspeed, and determining whether the combined repeated measurements satisfy a threshold.

10. The apparatus of claim 8, wherein the one or more programs further comprise instructions for calculating the first threshold airspeed value using an initial airspeed of the air purifier as measured by the anemometer.

11. The apparatus of claim 8, wherein:

the air purifier comprises one or more filters and a fan;

the second alert instructs a user to remove the one or more filters from the air purifier; and the one or more programs further comprise instructions for:

determining whether the airspeed of the air purifier with the one or more filters removed in accordance with the second alert satisfies a second threshold airspeed value, generating a third alert instructing the user to repair or replace the fan in response to a determination that the airspeed with the one or more filters removed in accordance with the second alert does not satisfy the second threshold airspeed value, and generating a fourth alert instructing the user to check the one or more filters in response to a determination that the airspeed with the one or more filters removed in accordance with the second alert satisfies the second threshold airspeed value.

12. The apparatus of claim 8, wherein the anemometer is selected from the group consisting of:

an anemometer to be coupled to an output of the air purifier by a tube, to measure the airspeed at the output of the air purifier;

an anemometer to be positioned at the output of the air purifier, to measure the airspeed at the output of the air purifier;

an anemometer to be coupled to an input of the air purifier by a tube, to measure the airspeed at the input of the air purifier; and an anemometer to be positioned at the input of the air purifier, to measure the airspeed at the input of the air purifier.

13. The apparatus of claim 1, wherein the first particle sensor and the second particle sensor are each an optical particle counter or a nephelometer.

14. An apparatus, comprising:

an anemometer to repeatedly measure an airspeed of an air purifier;

one or more processors coupled to the anemometer; and memory storing one or more programs for execution by the one or more processors, the one or more programs comprising instructions for:

determining whether the airspeed satisfies a first threshold airspeed value, comprising combining repeated measurements of the airspeed and determining whether the combined repeated measurements satisfy a threshold; and generating an alert in response to a determination that the airspeed does not satisfy the first threshold airspeed value.

15. An apparatus, comprising:

an anemometer to measure an airspeed of an air purifier;

one or more processors coupled to the anemometer; and memory storing one or more programs for execution by the one or more processors, the one or more programs comprising instructions for:

calculating a first threshold airspeed value using an initial airspeed of the air purifier as measured by the anemometer;

determining whether the airspeed satisfies the first threshold airspeed value; and generating an alert in response to a determination that the airspeed does not satisfy the first threshold airspeed value.

16. An apparatus, comprising:

an anemometer to measure an airspeed of an air purifier comprising one or more filters and a fan;

one or more processors coupled to the anemometer; and memory storing one or more programs for execution by the one or more processors, the one or more programs comprising instructions for:

determining whether the airspeed satisfies a first threshold airspeed value;

generating a first alert in response to a determination that the airspeed does not satisfy the first threshold airspeed value, wherein the first alert instructs a user to remove the one or more filters from the air purifier;

determining whether the airspeed of the air purifier with the one or more filters removed in accordance with the first alert satisfies a second threshold airspeed value;

generating a second alert instructing the user to repair or replace the fan in response to a determination that the airspeed with the one or more filters removed in accordance with the first alert does not satisfy the second threshold airspeed value; and generating a third alert instructing the user to check the one or more filters in response to a determination that the airspeed with the one or more filters removed in accordance with the first alert satisfies the second threshold airspeed value.

* * * * *